US012612084B2

(12) United States Patent
Huck et al.

(10) Patent No.: US 12,612,084 B2
(45) **Date of Patent: *Apr. 28, 2026**

(54) STORAGE ASSEMBLY FOR RAILCAR

(71) Applicant: Trinity Rail Group, LLC, Dallas, TX (US)

(72) Inventors: Kenneth W. Huck, Fairview, TX (US); Ross E. Hill, Irving, TX (US)

(73) Assignee: Trinity Rail Group, LLC, Dallas, TX (US)

( * ) Notice: Subject to any disclaimer, the term of this patent is extended or adjusted under 35 U.S.C. 154(b) by 239 days.

This patent is subject to a terminal disclaimer.

(21) Appl. No.: 18/517,237

(22) Filed: Nov. 22, 2023

(65) Prior Publication Data

US 2024/0083467 A1 Mar. 14, 2024

Related U.S. Application Data

(63) Continuation of application No. 16/787,324, filed on Feb. 11, 2020, now Pat. No. 11,827,250.

(60) Provisional application No. 62/821,064, filed on Mar. 20, 2019.

(51) Int. Cl.

| | |
|---|---|
| ***B61D 3/20*** | (2006.01) |
| ***B61D 5/02*** | (2006.01) |
| ***B61D 5/06*** | (2006.01) |
| ***B61D 45/00*** | (2006.01) |

(52) U.S. Cl.

CPC ..... *B61D 3/20* (2013.01); *B61D 5/02* (2013.01); *B61D 5/06* (2013.01); *B61D 45/007* (2013.01)

(58) Field of Classification Search

CPC ..... B61D 3/20; B61D 45/007; B61D 5/02; B61D 5/06; B61D 45/00; B61D 45/002; B61D 3/16; B60P 7/13

See application file for complete search history.

(56) References Cited

U.S. PATENT DOCUMENTS

| | | | | |
|---|---|---|---|---|
| 3,827,375 | A | 8/1974 | Terlecky | |
| 4,624,188 | A * | 11/1986 | Kaleta | B61D 17/06 410/94 |
| 4,862,810 | A * | 9/1989 | Jamrozy | B61F 1/00 105/355 |
| 5,183,375 | A * | 2/1993 | Fenton | B61D 3/20 410/82 |
| 5,730,063 | A * | 3/1998 | Forbes | B61D 45/007 105/355 |
| 8,151,714 | B2 | 4/2012 | Morris | |
| 9,809,358 | B2 * | 11/2017 | Lanigan, Sr. | B65D 90/0013 |
| 10,391,921 | B2 | 8/2019 | Kismarton | |
| 2018/0001915 | A1 * | 1/2018 | Richmond | E01B 31/18 |

FOREIGN PATENT DOCUMENTS

| | | | | |
|---|---|---|---|---|
| EP | 2765083 | A1 * | 8/2014 | B65B 69/0091 |

* cited by examiner

*Primary Examiner* — Cheng Lin

(74) *Attorney, Agent, or Firm* — Baker Botts L.L.P.

(57) ABSTRACT

An IBC storage box assembly is elevated from a railcar. A vertical beam is used to elevate the storage box off the railcar so that the storage box is more easily accessed from a rail platform. Additionally, the vertical beam may provide some clearance for the storage box so that the storage box is not impacted by the railcar coupler during transport.

20 Claims, 10 Drawing Sheets

STORAGE ASSEMBLY FOR RAILCAR

RELATED APPLICATIONS

This application is a continuation, under 35 U.S.C. § 120, of U.S. patent application Ser. No. 16/787,324 filed on Feb. 11, 2020, which claims priority to U.S. Provisional Application Ser. No. 62/821,064, entitled "Storage Assembly for Railcar", filed Mar. 20, 2019, both of which are hereby incorporated by reference in their entirety.

TECHNICAL FIELD OF THE DISCLOSURE

This disclosure relates generally to a storage assembly on a railcar.

BACKGROUND

Railcars (e.g. well cars) transport freight and cargo in containers. To increase the number of containers that are carried by a railcar, the containers may be stacked on top of one another on the railcar.

SUMMARY OF THE DISCLOSURE

Railcars (e.g. well cars) transport freight and cargo in containers. To increase the number of containers that are carried by a railcar, the containers may be stacked on top of one another on the railcar. Interbox connectors (IBC) are used to lock and secure two stacked containers to one another. This is called double-stacking.

When IBCs are not in use, they are stored in an IBC storage box on the railcar. An IBC storage box is typically positioned between two railcars to make it easier for users to access the IBC storage box. However, in that position, the IBC storage box is also close to the mechanism that couples railcars to each other. As a result, the IBC storage box may be easily damaged or cracked due to the vibration frequency or a direct impact from the railcar coupler during transportation or operation. Furthermore, to satisfy vibration and fatigue requirements, the IBC storage box and structures that secure the IBC storage box to the railcar may be large and/or heavy. As a result, the IBC storage boxes may reduce the amount of weight in freight and cargo that the railcar can carry.

Additionally, conventional IBC storage boxes are typically positioned at the level of the railcar. As a result, when the railcar is by a rail platform, the IBC storage boxes are positioned below the level of the platform. If an operator or user on the platform wants to access the IBC storage box, the operator or user may need to lean downwards from the platform or to drop down onto the railcar from the platform, which may result in injury.

This disclosure contemplates an IBC storage box assembly that is elevated from the railcar. A vertical beam is used to elevate the storage box off the railcar so that the storage box is more easily accessed from a rail platform. Additionally, the vertical beam may provide some clearance for the storage box so that the storage box is not impacted by the railcar coupler during transport. Certain embodiments of the storage box assembly are described below.

According to an embodiment, a railcar includes an articulated end and a first storage assembly. The articulated end couples the railcar to another railcar. The first storage assembly is coupled to the articulated end. The first storage assembly includes a first vertical beam and a first storage box. The first vertical beam is coupled directly to the articulated end. The first vertical beam extends vertically upwards from the articulated end. The first vertical beam extends vertically higher than the articulated end. The first storage box is coupled to the first vertical beam such that the first storage box is positioned above the articulated end and such that the first storage box extends from the first vertical beam away from the articulated end. The first storage box stores an interbox connector.

According to another embodiment, an articulated end, a first storage assembly, and a second storage assembly. The articulated end couples the railcar to another railcar. The first storage assembly is coupled to the articulated end. The first storage assembly includes a first vertical beam and a first storage box. The first vertical beam is coupled directly to the articulated end. The first vertical beam extends vertically upwards from the articulated end. The first vertical beam extends vertically higher than the articulated end. The first storage box is coupled to the first vertical beam such that the first storage box is positioned above the articulated end and such that the first storage box extends from the first vertical beam away from the articulated end. The first storage box stores an interbox connector. The second storage assembly is coupled to the articulated end. The second storage assembly includes a second vertical beam and a second storage box. The second vertical beam is coupled directly to the articulated end. The second vertical beam extends vertically upwards from the articulated end. The second vertical beam extends vertically higher than the articulated end. The second storage box is coupled to the second vertical beam such that the second storage box is positioned above the articulated end and such that the second storage box extends from the second vertical beam away from the articulated end. The second storage box stores an interbox connector.

Certain embodiments disclosed herein may contain or embody one or more technical advantages. As an example, certain embodiments may improve the durability of the IBC storage assembly and lessen the weight and the complexity of the IBC storage assembly. Particular embodiments may provide various heights of the IBC storage assembly to fit a user's needs. In addition, particular embodiments may provide more storage space for an IBC at a lower cost.

In particular embodiments, the vertical element of the IBC storage assembly may be an upward or downward shaft away from an operation platform of a car to lessen the vibration from the operation. Furthermore, the height of the vertical element may be adjustable to satisfy the user's need and/or the vibration and fatigue requirements. Particular embodiments may strengthen the structure of the IBC storage assembly with a minimum of weight by adding a reinforcement which connects the storage box and the vertical element.

Other objects, features, and advantages of the present disclosure are apparent to persons of ordinary skill in the art in view of the following detailed description of the disclosure and the accompanying drawings.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Certain embodiments of the present disclosure and inventive concepts, and their features and advantages, may be understood by referring to FIGS. 1A to 9, like numerals being used for corresponding parts in the various drawings.

Railcars (e.g. well cars) transport freight and cargo in containers. To increase the number of containers that are carried by a railcar, the containers may be stacked on top of one another on the railcar. Interbox connectors (IBC) are used to lock and secure two stacked containers to one another. This is called double-stacking.

When IBCs are not in use, they are stored in an IBC storage box on the railcar. An IBC storage box is typically positioned between two railcars to make it easier for users to access the IBC storage box. However, in that position, the IBC storage box is also close to the mechanism that couples railcars to each other. As a result, the IBC storage box may be easily damaged or cracked due to the vibration frequency or a direct impact from the railcar coupler during transportation or operation. Furthermore, to satisfy vibration and fatigue requirements, the IBC storage box and structures that secure the IBC storage box to the railcar may be large and/or heavy. As a result, the IBC storage boxes may reduce the amount of weight in freight and cargo that the railcar can carry.

Additionally, conventional IBC storage boxes are typically positioned at the level of the railcar. As a result, when the railcar is by a rail platform, the IBC storage boxes are positioned below the level of the platform. If an operator or user on the platform wants to access the IBC storage box, the operator or user may need to lean downwards from the platform or to drop down onto the railcar from the platform, which may result in injury.

Figure 1A:
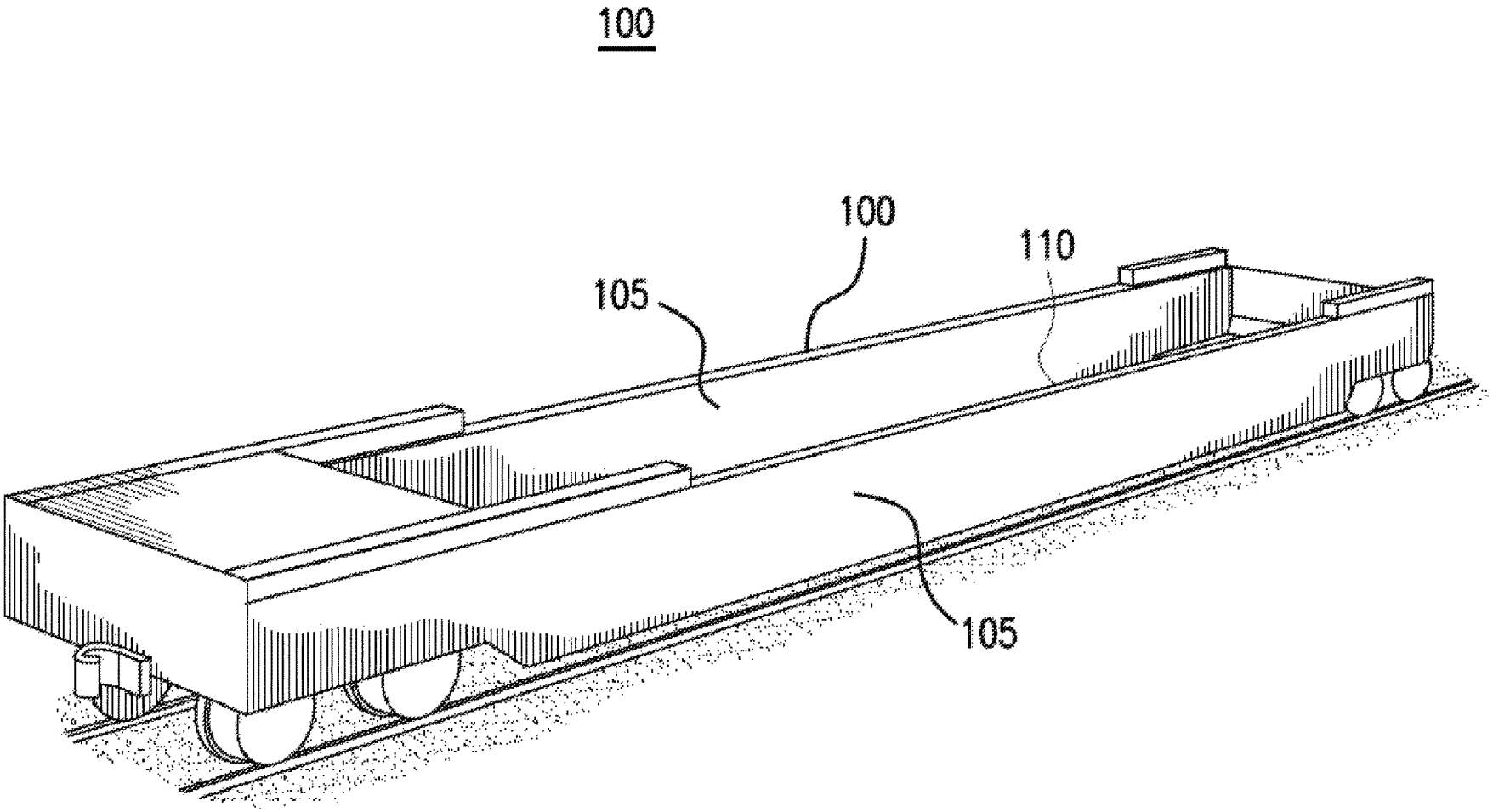
FIG. 1A illustrates an example railcar.
Figure 1B:
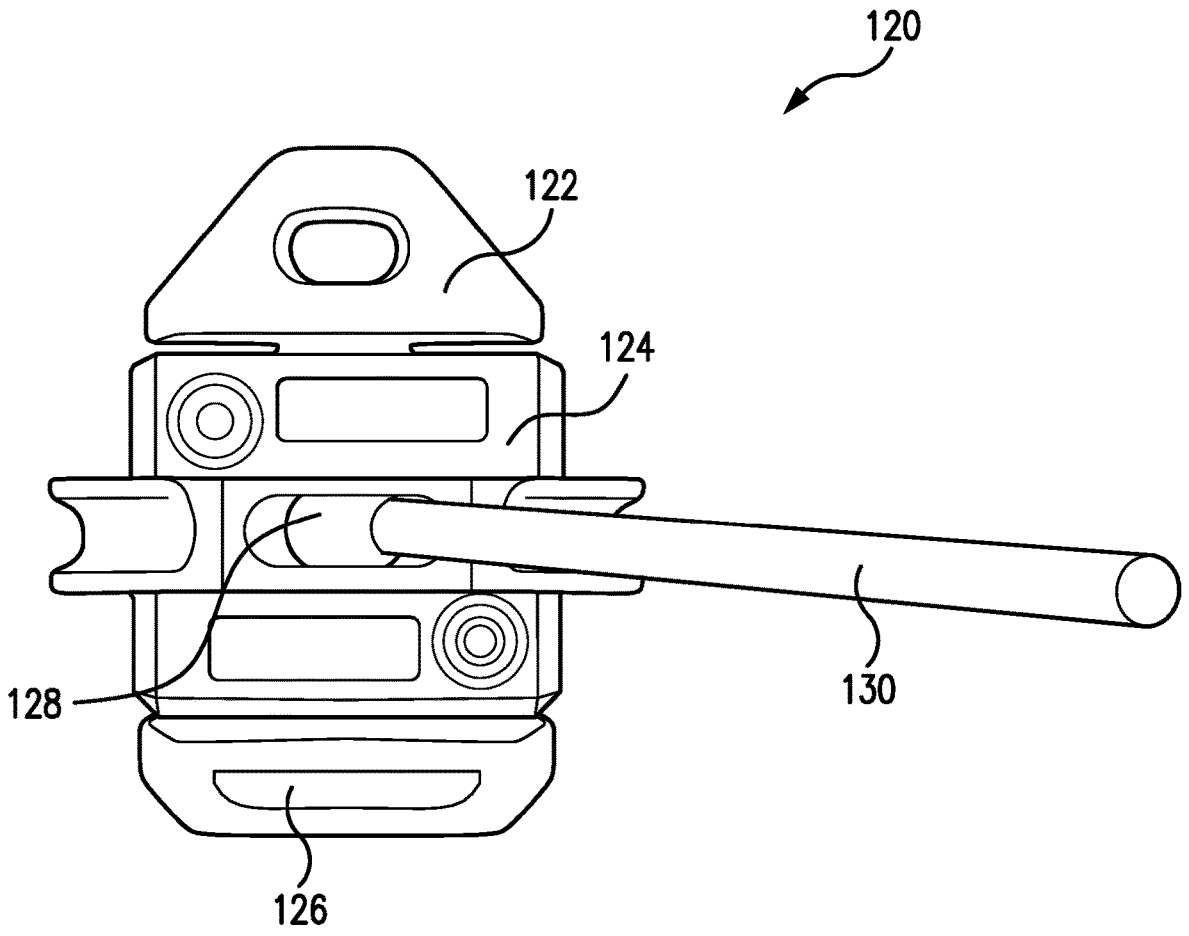
FIG. 1B illustrates an example interbox connector (IBC)
Figure 2A:
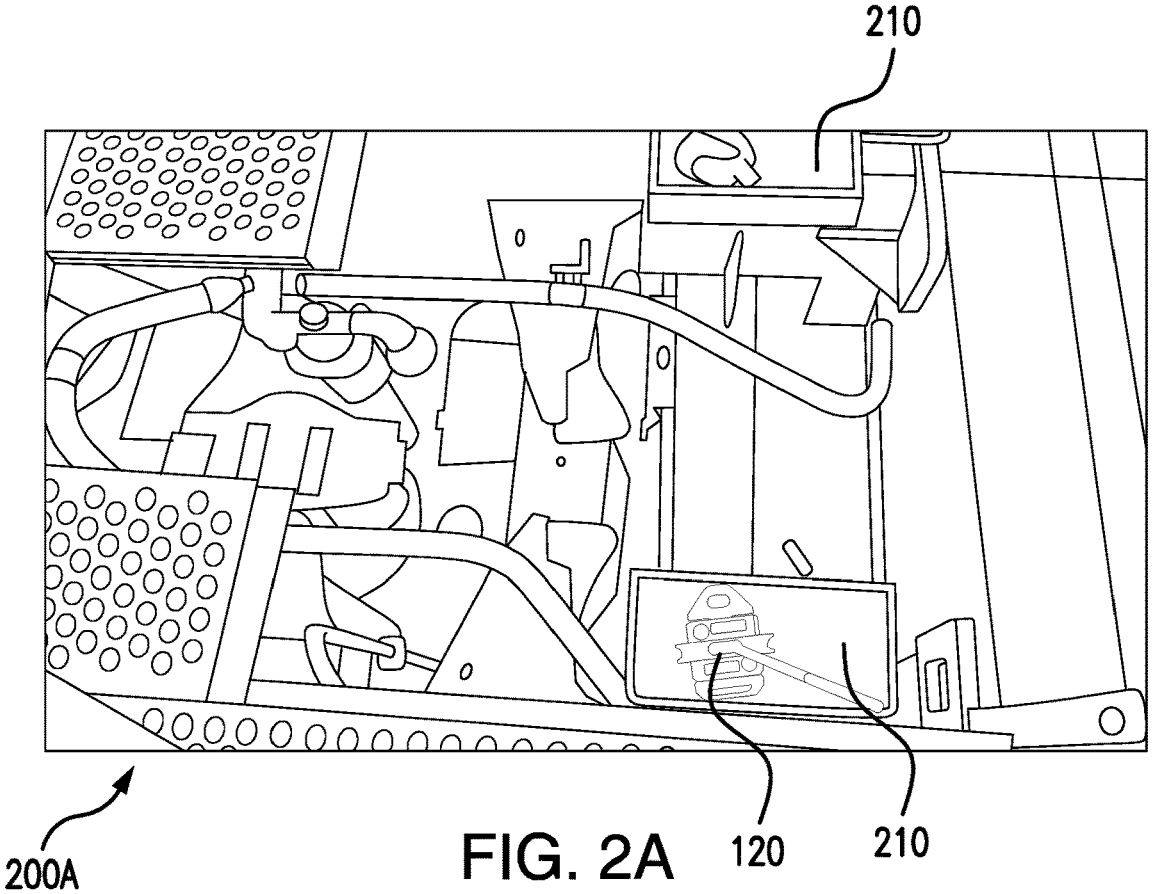
FIGS. 2A and 2B illustrate conventional IBC storage boxes in a railcar.
Figure 2B:
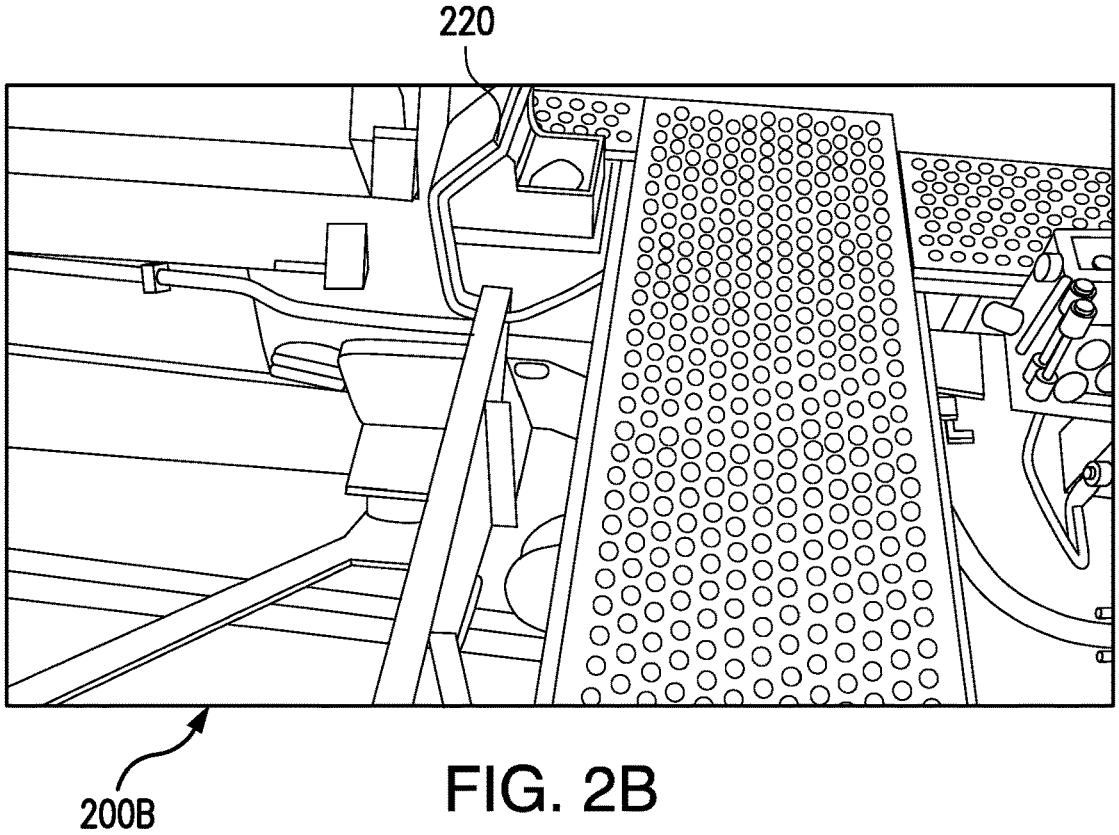

This disclosure contemplates an IBC storage box assembly that is elevated from the railcar. A vertical beam is used to elevate the storage box off the railcar so that the storage box is more easily accessed from a rail platform. Additionally, the vertical beam may provide some clearance for the storage box so that the storage box is not impacted by the railcar coupler during transport. Particular embodiments include an interbox connector (IBC) storage assembly used in a railcar. The IBC storage assembly includes a storage box and a vertical element. The vertical element keeps the storage box away from an operation platform of the railcar and other car elements such that the storage box is protected from the interference during transportation and is more accessible to a user. Furthermore, the storage box is configured to store at least two IBCs. As a result, the IBC storage assembly provides more storage room with less weight and cost. The IBC storage box assembly will be described in more detail using FIGS. 1A-9. FIGS. 1A and 1B describe a railcar and an IBC connector. FIGS. 2A and 2B describe a conventional IBC storage box. FIGS. 3-9 describe embodiments of the improved IBC storage box assembly.

FIG. 1A illustrates an example railcar 100. In certain embodiments, railcar 100 is a well car that includes a well used to carry freight. Freight (e.g. shipping containers) is loaded into the well car, which transports the freight on rails to the destination. Well car 100 includes side assemblies 105 that form boundaries for the well of well car 100. Side assemblies 105 include a section called a top chord 110. As seen in FIG. 1A, top chord 110 for well car 100 includes a section that runs across the length of well car 100.

Shipping containers are loaded onto railcar 100 for transport. To increase the number of containers that railcar 100 holds, the containers may be stacked on top of one another. Interbox connectors (IBCs) are used to secure the containers (e.g., an upper container and a lower container) to each other when they are stacked on one another. FIG. 1B illustrates an example IBC 120 used in double-stacking containers. The IBC 120 includes an upper lock 122, a hollow body 124, a lower lock 126, a shaft 128, and a side handle 130. The upper lock 122 engages with an upper container, and the lower lock 106 engages a lower container. The upper lock 102 is coupled to the lower lock 106 via the shaft 108, which is rotatably disposed through the hollow body 104. The side handle 110 is coupled to the shaft 108 in the hollow body 104 and allows a user to lock/unlock the upper lock 102 and the lower lock 106 of the IBC 100. When locked, an upper container engaged with the upper lock 122 and a lower container engaged with the lower lock 126 are secured to IBC 120. As a result, the upper container and lower container do not separate from IBC 120 during transport. At least four IBCs 120 are used to fix two stacking containers together. For example, one IBC 120 may be used to secure each corner of a rectangular shipping container. While the IBC 120 is not in use, such as when unloading or unstacking the containers, the IBC 120 is stored in an IBC storage box. Conventionally, one IBC storage box stores one IBC 120. Thus, at least four IBC storage boxes are conventionally present for each railcar 100.

FIGS. 2A and 2B illustrate two conventional IBC storage boxes 210 used in a railcar. In FIG. 2A, IBC storage boxes 210 are installed at an articulated end of an intermediate well 200A of the railcar. Each articulated end of the intermediate well 200A includes two IBC storage boxes 210. Therefore, the intermediate well 200A includes four IBC storage boxes in total because the intermediate well 200A has two articulated ends. When the railcar is coupled to another railcar, two IBC boxes 210 from two separated intermediate wells 200A are positioned opposite to each other. During transportation, due to a narrow space between the two intermediate wells 200A, the IBC boxes 210 may easily interfere with adjacent car components, in particular, when the railcar is in a curve on the rail, which may result in damage to IBC boxes 210 or the railcar. Furthermore, the IBC boxes 210 may be impacted by other car components, which may damage IBC boxes 210 or the railcar.

FIG. 2B illustrates an IBC storage box 220 used in an end well 200B of a railcar. The end well 200B has a coupler end and an articulated end. The articulated end may couple with the articulated end of the intermediate well 200A, and the coupler end may couple with a locomotive or any suitable power vehicle. The IBC storage box 220 is installed at the coupler end of the end well 200B. Therefore, the IBC storage box 200 may also be interfered with by any components coupled at the coupler end of the end well 200B, which may result in damage to the IBC box 220 or to the railcar.

Figure 3:
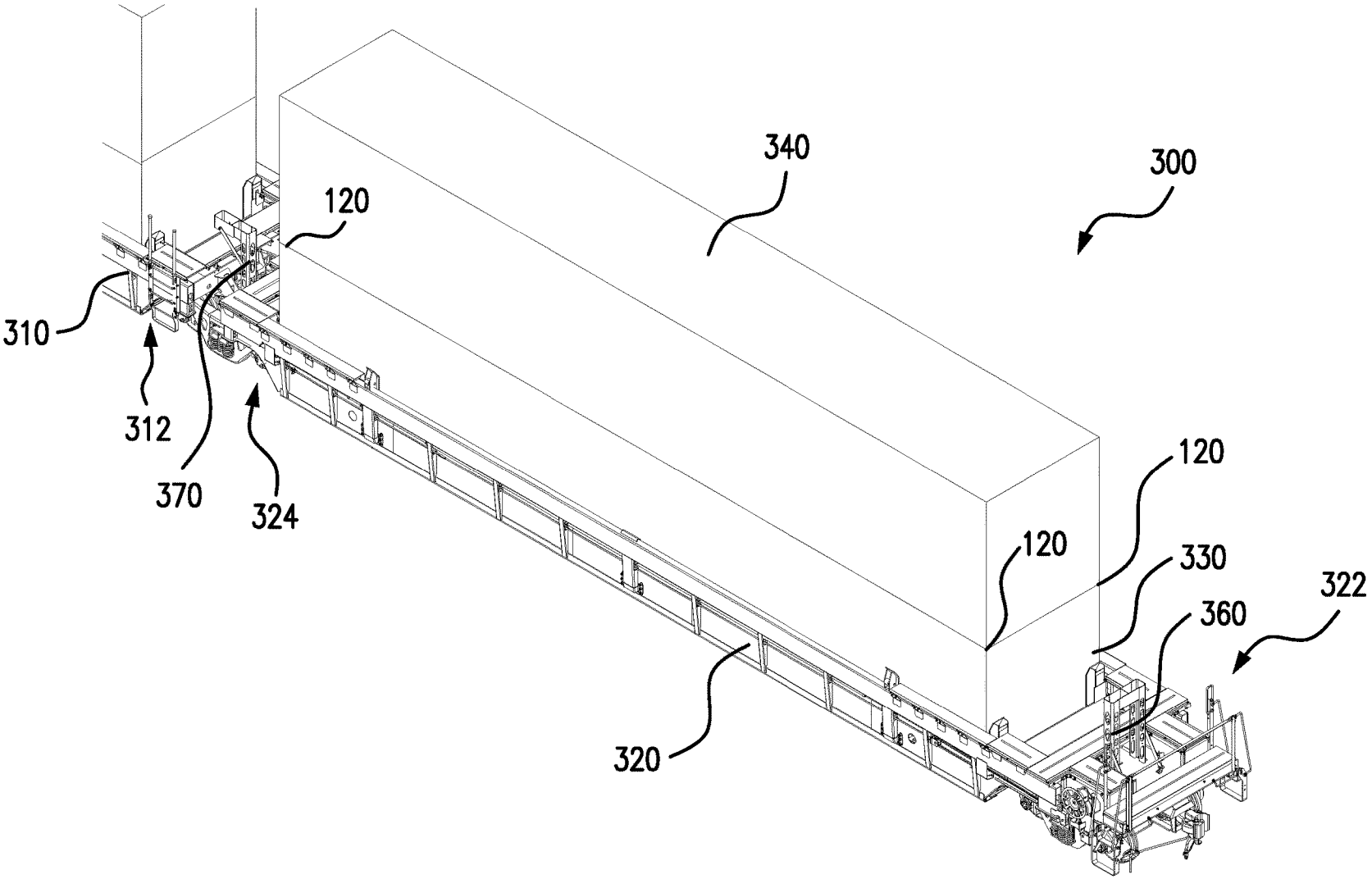
FIG. 3 illustrates a perspective view of an example IBC storage assembly in a railcar, in accordance with certain embodiments.

FIG. 3 illustrates an example well car 300 having example IBC storage assemblies 360 and 370, in accordance with certain embodiments. The well car 300 includes at least one intermediate well 310 and an end well 320. Both the intermediate well 310 and the end well 320 may carry International Organization for Standardization (ISO) containers. ISO containers come in lengths of 20 ft., 40 ft., and 53 ft., etc. These containers are placed inside the intermediate well 310 and the end well 320 for transport. For example, a first container 330 is placed inside the end well 320, and a second container 340 is placed on top of the first container 330. The first container 330 and the second container 340 are secured and locked with each other via four IBC s 120 (e.g., an IBC 120 to secure each corner of containers 330 and 340 to each other). Likewise, the intermediate well 310 may carry double-stacking containers via the similar operations.

The intermediate well 310 has two articulated ends 312. The articulated end 312 is disposed with an articulated connector, which allows the intermediate well 310 to be coupled to another intermediate well 310 or the end well 320. In some embodiments, an IBC storage assembly 370 is installed at one articulated end 312 or both the articulated ends 312 of the intermediate well 310. In certain embodiments, the IBC storage assembly 370 is disposed upward or downward from an operation platform of the intermediate well 310. The end well 320 may have a coupler end 322 and an articulated end 324. The articulated end 324 of the end well 320 is configured to be coupled to the articulated end 312 of the intermediate well 310 via the articulated connector. The coupler end 324 of the end well 320 includes a standard coupler arrangement which allows the end well 320 to be coupled to any appropriate power vehicles, motors, locomotives, and the like. In some embodiments, an IBC storage assembly 360 is installed at the coupler end 322. In some embodiments, the IBC storage assembly 370 is installed at the articulated end 324 of the end well 320. In certain embodiments, the IBC storage assembly 370 is disposed upward or downward from the operation platform of the end well 320. In certain embodiments, the IBC storage assemblies 360 and 370 are installed in any type of railcar which is suitable to carry double-stacking containers using the IBCs 120. In some embodiments, the IBC storage assemblies 360 and 370 are disposed in any part of a well car 300 to provide various storages in different heights.

Figure 4:
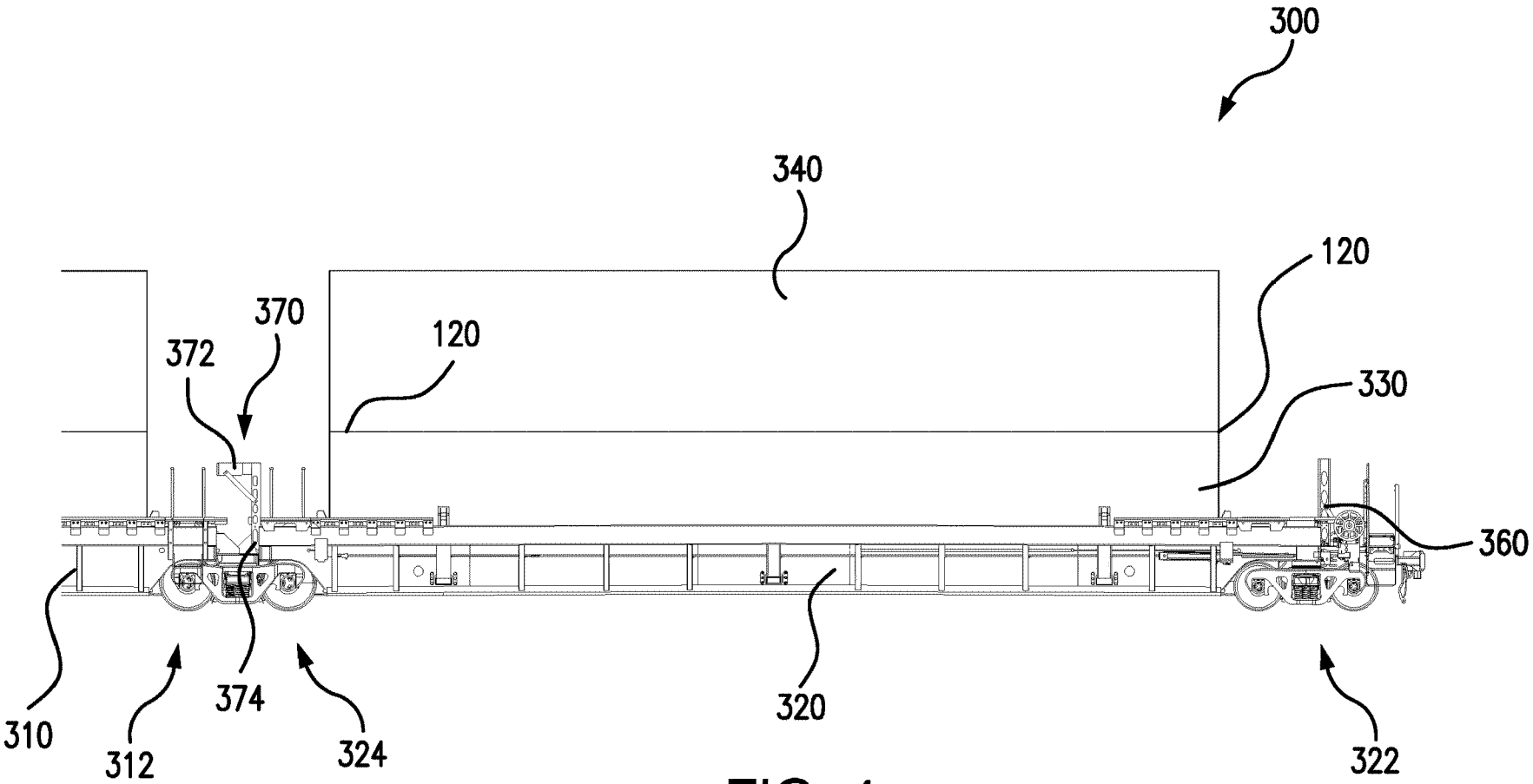
FIG. 4 illustrates a side view of an example IBC storage assembly in a railcar, in accordance with certain embodiments.

FIG. 4 illustrates example IBC storage assemblies 360 and 370 disposed in the end well 320 of the well car 300, in accordance with certain embodiments. The end well 320 includes an IBC storage assembly 360 disposed at the coupler end 322 and another IBC storage assembly 370 disposed at the articulated end 324. In some embodiments, the IBC assembly 370 includes a storage box 372 and a vertical element 374. The vertical element 374 has two ends, in which one end attaches to the articulated end 324 of the end well 320 and is extended upward or downward from an operation platform of the end well 320, while the other end of the vertical element 374 is coupled to the storage box 372 to hold the storage box 372 away from the operation platform of the end well 320. The storage box 372 may store at least two IBCs 120.

Figure 5:
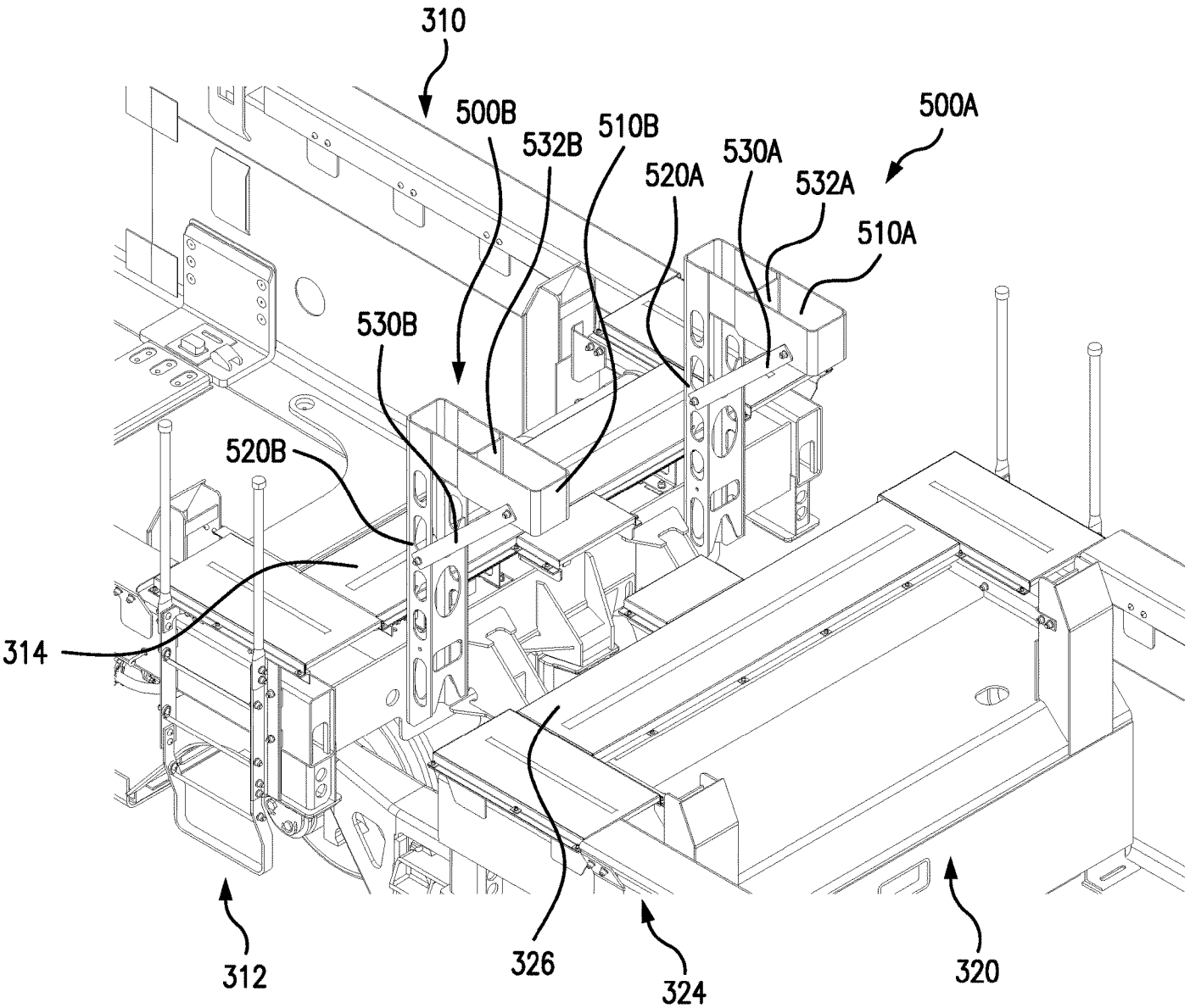
FIG. 5 illustrates a perspective view of an example IBC storage assembly between two cars, in accordance with certain embodiments.

FIG. 5 illustrates two example IBC storage assemblies 500A and 500B installed at the articulated end 312 of the intermediate well 310, in accordance with certain embodiments. The IBC storage assemblies 500A and 500B each include a storage box 510A or 510B and a vertical element 520A or 520B. The vertical elements 520A and 520B each have two ends. One end is connected to the articulated end 312 of the intermediate well 310 and is extended upward from an operation platform 314 of the intermediate well 310, and the other end of the vertical elements 520A and 520B is coupled to the storage boxes 510A and 510B to hold the storage boxes 510A and 510B away from an operation platform 314 of the intermediate well 310 (e.g., the storage boxes 510A and 510B extend from the vertical elements 520A and 520B away from the articulated end 312). In some embodiments, the vertical elements 520A and 520B are beams formed of a lightweight alloy, a plastic, a metal (e.g. steel), a composite (e.g. fiberglass), or any other suitable material as would be appreciated by one of ordinary skill in the art upon viewing this disclosure. The two IBC storage assemblies 500A and 500B may be separated from each other by an appropriate distance.

The storage boxes 510A and 510B are designed to store IBCs 120. In some embodiments, the storage boxes 510A and 510B are designed to store at least two IBCs 120. In some embodiments, the storage boxes 510A and 510B are extended outward from the intermediate well 310, such that the storage boxes 510A and 510B stay away from the container placed inside the intermediate well 310 to avoid interfering with or impacting the container. In some embodiments, the storage boxes 510A and 510B include separations 532A and 532B to create several compartments, one for each IBC 120. The IBC storage assemblies 500A and 500B may further include reinforcements 530A and 530B, which improve the durability of the IBC storage assemblies 500A and 500B. In some embodiments, the reinforcements 530A and 530B are supports that connect an outward end of the storage boxes 510A and 510B and a body of the vertical elements 520A and 520B to strengthen the structure of the IBC storage assemblies 500A and 500B. In some embodiments, the IBC storage assemblies 500A and 500B include a hand rail or a hand hold coupled to the storage boxes 510A and 510B, such that a user may secure his/her safety when reaching towards the IBC 120 in the storage boxes 510A and 510B. In some embodiments, the intermediate well 310 includes two IBC storage assemblies 500A and 500B to store four IBCs 120 in total. In some embodiments, the intermediate well 310 includes one IBC storage assembly 500 that includes two or more storage boxes 510 for storing a sufficient number of IBCs 120 for two adjacent intermediate wells 310.

Figure 6:
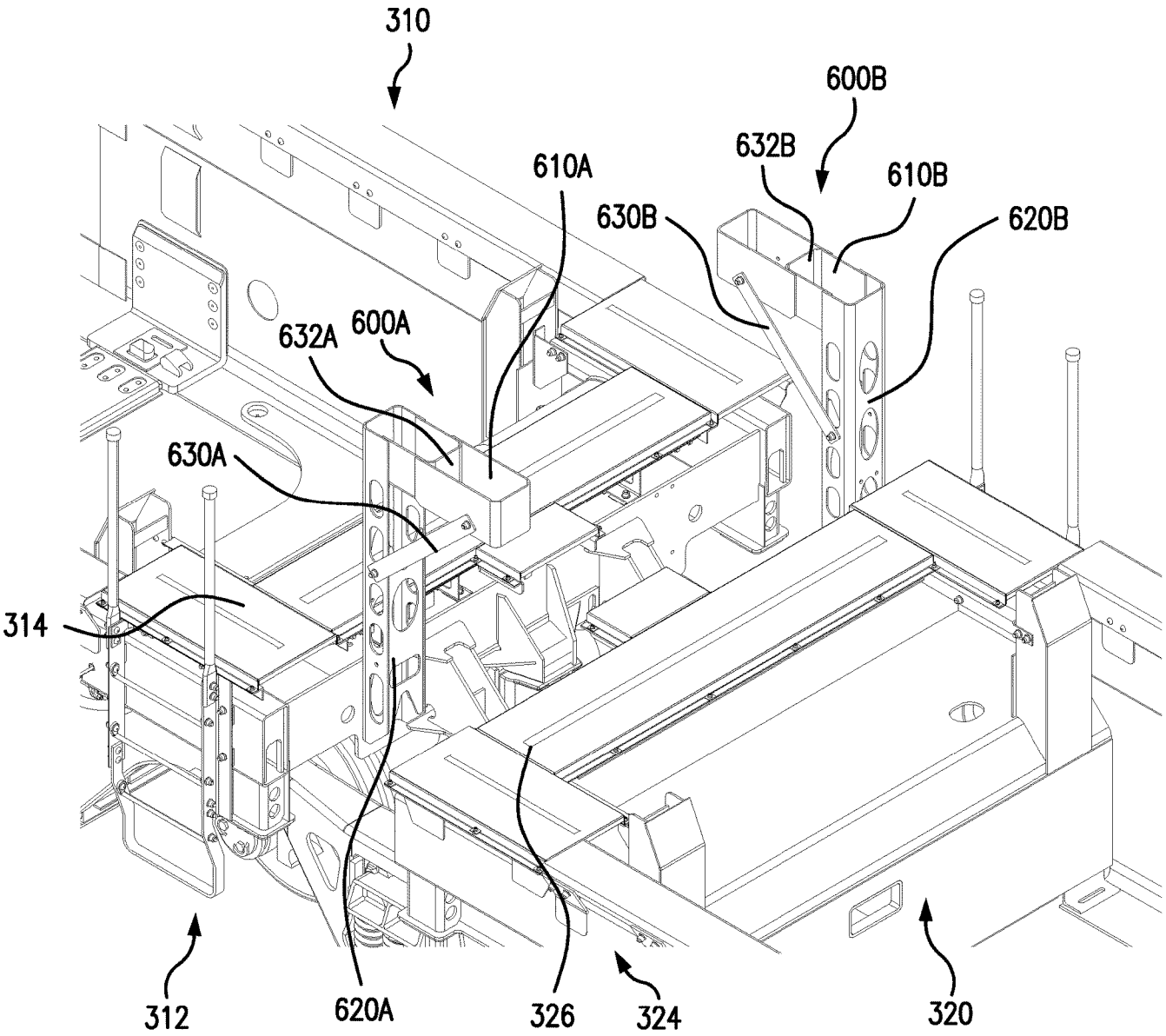
FIG. 6 illustrates a perspective view of another example IBC storage assembly between two cars, in accordance with certain embodiments.

FIG. 6 illustrates additional example IBC storage assemblies 600A and 600B installed at the intermediate well 310 and the end well 320, in accordance with certain embodiments. Storage assembly 600A is coupled to intermediate well 310 and storage assembly 600B is coupled to end well 320. The IBC storage assembly 600A includes a storage box 610A and a vertical element 620A. The vertical element 620A has two ends. One end is connected to the articulated end 312 of the intermediate well 310 and is extended upward from the operation platform 314 of the intermediate well 310, and the other end of the vertical element 620A is coupled to the storage box 610A to hold the storage box 610A away from the operation platform 314 of the intermediate well 310. The storage box 610A is extended outward from the intermediate well 310 and toward the end well 320, such that the storage box 610A may stay away from the container placed inside the intermediate well 310 and yet still be far away enough from the container placed in the end well 320.

The IBC storage assembly 600B includes a storage box 610B and a vertical element 620B. The vertical element 620B has two ends. One end is connected to the articulated end 324 of the end well 320 and is extended upward from an operation platform 326 of the end well 320, and the other end of the vertical element 620B is coupled to the storage box 610B to hold the storage box 610B away from the operation platform 326 of the end well 320. The storage box 610B is extended outward from the end well 320 and toward the intermediate well 310, such that the storage box 610B may stay away from the container placed inside the end well 320 and yet still be far away enough from the container placed in the intermediate well 310. In certain embodiments, the IBC storage assembly 600A at the intermediate well 310 is separated from the IBC storage assembly 600B at the end well 320 parallelly by an appropriate distance, such that outward ends of the storage boxes 610A and 610B do not impact or interfere with each other. In some embodiments, the storage boxes 610A and 610B include a separation 632A and 632B to create several compartments for each IBC 120. The IBC storage assemblies 600A and 600B may further include reinforcements 630A and 630B. The reinforcements 630A and 630B connect the outward end of the storage boxes 600A and 600B and a body of the vertical elements 620A and 620B, such that the reinforcements 630A and 630B improve the durability of the IBC storage assemblies 600A and 600B. In some embodiments, the IBC storage assemblies 600A and 600B include a hand rail or a hand hold coupled to the storage boxes 610A and 610B, such that a user may secure his/her safety when reaching toward the IBC 120 in the storage boxes 610A and 610B.

Figure 7:
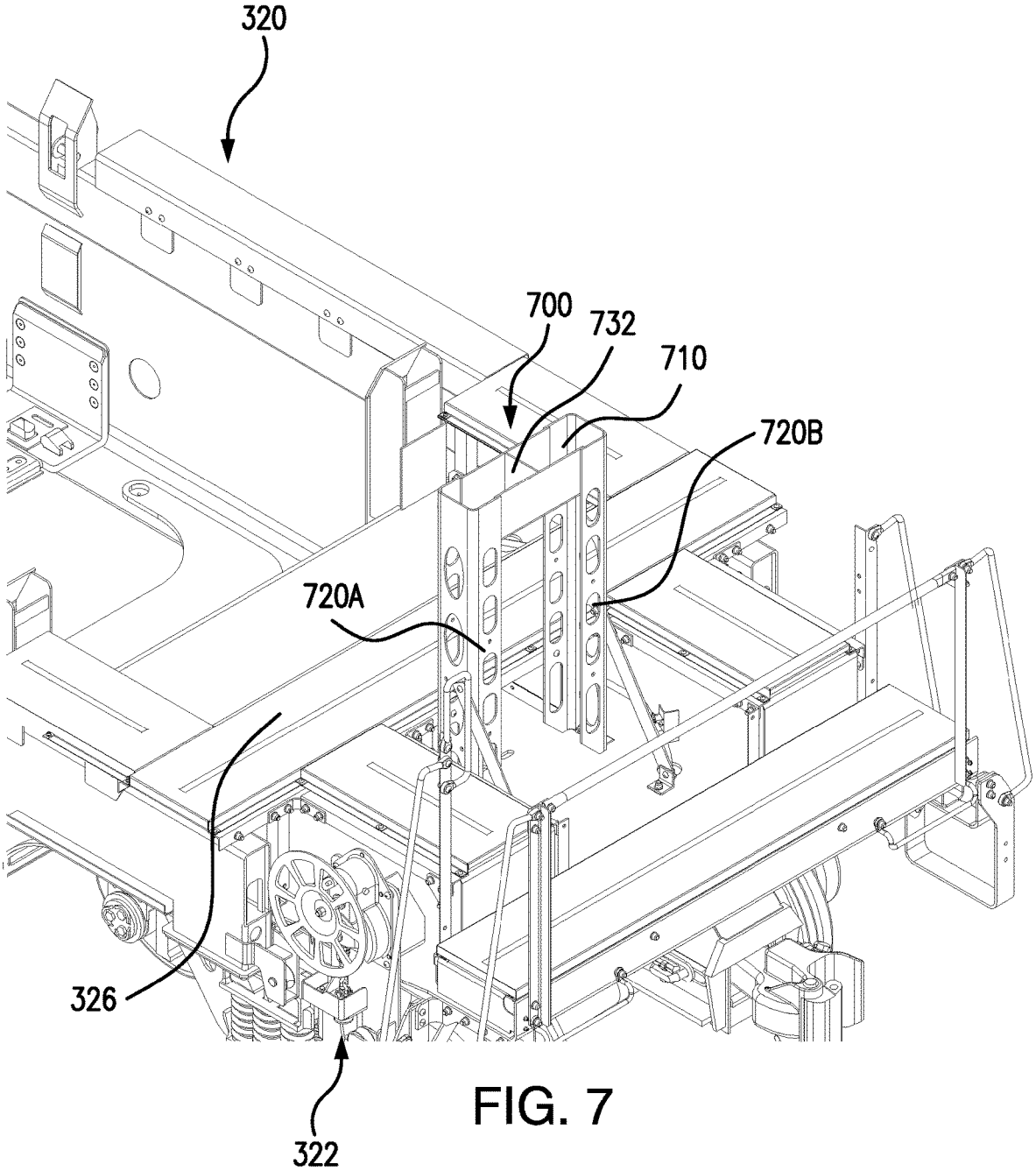
FIG. 7 illustrates a perspective view of an example IBC storage assembly at a coupler end of a car, in accordance with certain embodiments.

FIG. 7 illustrates another example IBC storage assembly 700 installed at the coupler end 322 of the end well 320, in accordance with certain embodiments. The IBC storage assembly 700 includes a storage box 710 and two vertical elements 720A and 720B. The storage box 710 has two ends and each end is supported by the vertical elements 720A and 720B. Each vertical element 720A and 720B has two ends. One end is connected to the coupler end 322 of the end well 320 and is extended upward from the operation platform 326 of the end well 310, and the other end is coupled to the storage box 710 to hold the storage box 710 away from the operation platform 326 of the end well 320. As seen in FIG. 7, storage box 710 is positioned between the vertical elements 720A and 720B In some embodiments, the storage box 710 is positioned away from the container placed in end well 320 and the operation platform 326 of the end well 320.

Figure 8A:
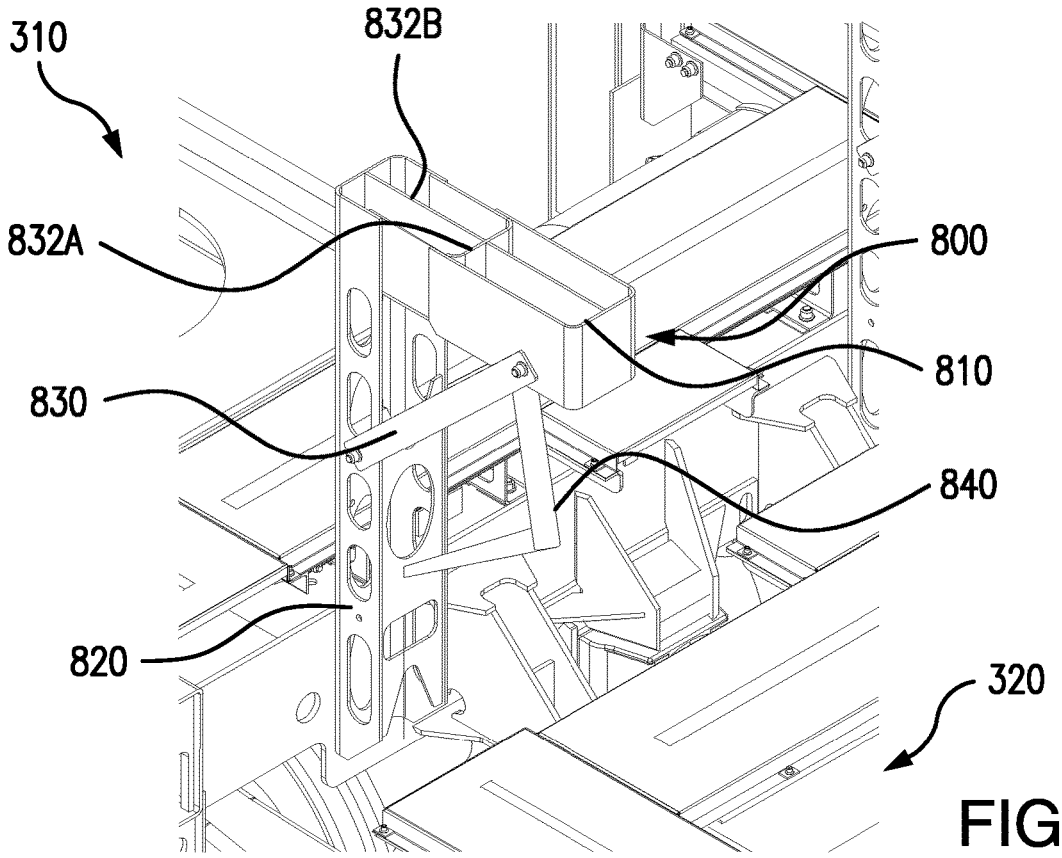
FIGS. 8A and 8B illustrate a perspective view and a top view of another example IBC storage assembly between two cars, in accordance with certain embodiments.
Figure 8B:
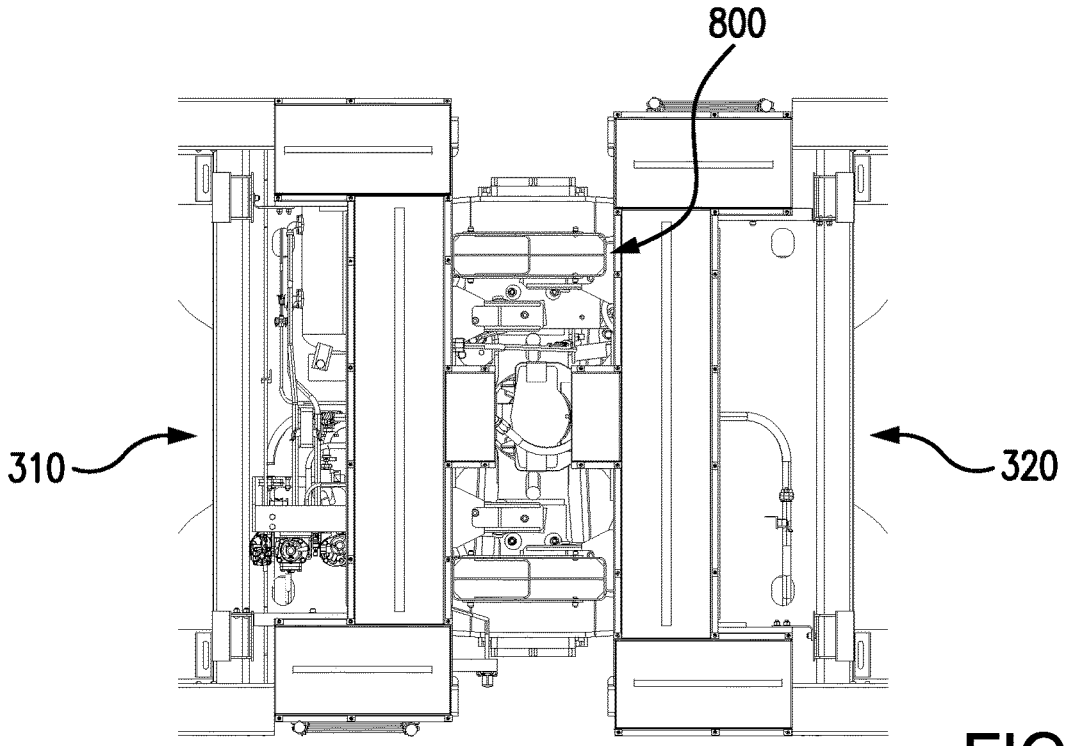

FIGS. 8A and 8B illustrate another example IBC storage assembly 800 installed at the intermediate well 310, in accordance with certain embodiments. In some embodiments, the IBC storage assembly 800 may be installed at the end well 320. In some embodiments, the IBC storage assembly 800 includes a storage box 810 and a vertical element 820. The vertical element 820 has two ends. One end is connected to the intermediate well 310, and the other end of the vertical element 820 is coupled to the storage box 810 to hold the storage box 810. The storage box 810 may be configured to store at least four IBCs (or any other suitable tools or elements for a railcar). For example, the storage box 810 may include separators 832A and 832B that divide the storage box 810 into four compartments that can hold an IBC 120. In certain embodiments, two or more storage assemblies 800 are installed at intermediate well 310 and/or end well 320, as described using previous figures.

In some embodiments, the storage box 810 includes two or more storage compartments. In some embodiments, the IBC storage assembly 800 includes a reinforcement 830 which is coupled to an outward end of the storage box 810 and a body of the vertical element 820 to strengthen the structure of the IBC storage assembly 800. In some embodiments, the IBC storage assembly 800 includes a hand rail 840 coupled to the storage box 810 and/or the vertical element 820, such that a user may secure his/her safety when reaching towards the IBCs 120 in the storage box 810. This hand rail 840 may be similarly installed in the examples shown in FIGS. 3-7.

Figure 9:
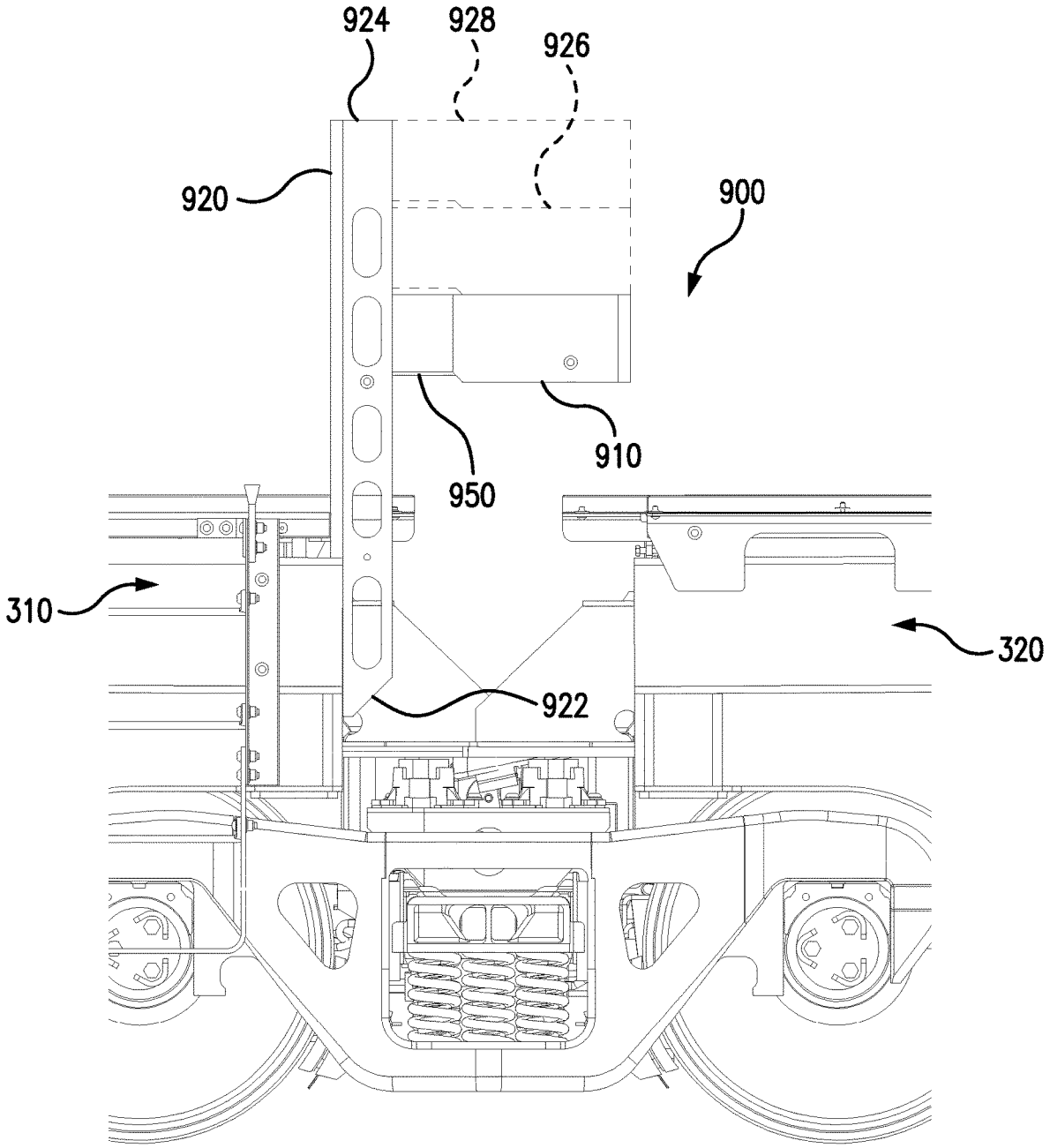
FIG. 9 illustrates a side view of an example IBC storage assembly with an adjustable element, in accordance with certain embodiments.

FIG. 9 illustrates yet another example IBC storage assembly 900 installed at the intermediate well 310, in accordance with certain embodiments. The IBC storage assembly 900 includes a storage box 910 and a vertical element 920. The vertical element 920 has two ends which are a coupling end 922 and an open end 924. The coupling end 922 of the vertical element is connected to the intermediate well 310, and the open end 924 of the vertical element 920 is coupled to the storage box 910 to hold the storage box 910 away from the intermediate well 310. The storage box 910 may store at least two IBCs 120 (or any other suitable tools or elements for a railcar). In some embodiments, the IBC storage assembly 900 is installed at the end well 320. In some embodiments, the IBC storage assembly 900 includes an adjustable element 950, such that the adjustable element 950 may mount the storage box 910 along the vertical element 920 to position the storage box 910 at various heights. In some embodiments, the storage box 910 is mounted to the vertical element 920 at a first height 926 using the adjustable element 950. In some embodiments, the storage box 910 is mounted to the open end 924 of the vertical element 920 at a second height 928 using the adjustable element 950. For example, the vertical element 920 may include multiple through-holes along its body, some through-holes being positioned higher than other through-holes. The adjustable element 950 may be a fixation set, such as a bolt and a nut, which may mount the storage box 910 via any one of the through-holes of the vertical element 920 based on the user's need. In some embodiments, the adjustable element 950 may be a sliding track system installed along the vertical element 920 to position the storage box 910 at various heights.

Particular embodiments of the present disclosure may provide numerous technical advantages. For example, particular embodiments may improve the durability of the IBC storage box and the storage for IBC with less weight and complexity. In addition, particular embodiments may provide an accessible height of a storage for a user which further avoids interference to adjacent car elements and facilitates the operations in a railcar.

Although particular embodiments and their advantages have been described in detail, it should be understood that various changes, substitutions and alternations can be made herein without departing from the spirit and scope of the embodiments. Particular embodiments of the present disclosure described herein may be used or mounted for a railroad car, a semi-trailer, a truck or any other transportations.

The invention claimed is:

1. A railcar comprising:

an articulated end configured to couple the railcar to another railcar; and a first storage assembly coupled to the articulated end, the first storage assembly comprising:

a first vertical beam coupled directly to the articulated end, the first vertical beam extending vertically upwards from the articulated end, the first vertical beam extending vertically higher than the articulated end; and a first storage box coupled to the first vertical beam such that the first storage box is positioned above the articulated end and such that the first storage box extends from the first vertical beam away from the articulated end, the first storage box configured to store an interbox connector;

wherein a vertical position of the first storage box on the first vertical beam is adjustable.

2. The railcar of claim 1, further comprising a second storage assembly coupled to the articulated end, the second storage assembly comprising:

a second vertical beam coupled directly to the articulated end, the second vertical beam extending vertically upwards from the articulated end, the second vertical beam extending vertically higher than the articulated end; and a second storage box coupled to the second vertical beam such that the second storage box is positioned above the articulated end and such that the second storage box extends from the second vertical beam away from the articulated end, the second storage box configured to store an interbox connector.

3. The railcar of claim 1, further comprising:

a coupler end configured to couple the railcar to a locomotive;

a second storage assembly coupled to the coupler end, the second storage assembly comprising:

a second vertical beam coupled directly to the coupler end, the second vertical beam extending vertically upwards from the coupler end, the second vertical beam extending vertically higher than the coupler end;

a third vertical beam coupled directly to the coupler end, the third vertical beam extending vertically upwards from the coupler end, the third vertical beam extending vertically higher than the coupler end; and a second storage box coupled to the second and third vertical beams such that the second storage box is positioned above the coupler end and such that the second storage box is positioned between the second and third vertical beams, the second storage box configured to store an interbox connector.

4. The railcar of claim 1, wherein the first storage box comprises a first section and a second section, the first section separated from the second section, the first section configured to store a first interbox connector, the second section configured to store a second interbox connector.

5. The railcar of claim 1, wherein the first storage assembly further comprises a reinforcement arm coupled to the first vertical beam and the first storage box.

6. The railcar of claim 1, wherein the first storage assembly further comprises a handrail coupled to the first storage box.

7. The railcar of claim 1, wherein:

the first vertical beam defines a first hole and a second hole, the second hole positioned vertically higher than the first hole; and the first storage box configured to couple to the first vertical beam through one of the first or second holes by a nut and a bolt.

8. The railcar of claim 1, further comprising a well configured to hold an International Organization for Standardization container.

9. The railcar of claim 1, wherein the first storage box comprises a first section, a second section, a third section, and a fourth section, the first section separated from the second, third, and fourth sections, the second section separated from the first, third, and fourth sections, the third section separated from the first, second, and fourth sections, the fourth section separated from the first, second, and third sections, the first section configured to store a first interbox connector, the second section configured to store a second interbox connector, the third section configured to store a third interbox connector, the fourth section configured to store a fourth interbox connector.

10. A railcar comprising:

an articulated end configured to couple the railcar to another railcar; and a first storage assembly coupled to the articulated end, the first storage assembly comprising:

a first vertical beam coupled directly to the articulated end, the first vertical beam extending vertically upwards from the articulated end, the first vertical beam extending vertically higher than the articulated end; and a first storage box coupled to the first vertical beam such that the first storage box is positioned above the articulated end and such that the first storage box extends from the first vertical beam away from the articulated end, the first storage box configured to store an interbox connector;

wherein:

the first vertical beam defines a first hole and a second hole, the second hole positioned vertically higher than the first hole; and the first storage box configured to couple to the first vertical beam through one of the first or second holes by a nut and a bolt.

11. The railcar of claim 10, further comprising a second storage assembly coupled to the articulated end, the second storage assembly comprising:

a second vertical beam coupled directly to the articulated end, the second vertical beam extending vertically upwards from the articulated end, the second vertical beam extending vertically higher than the articulated end; and a second storage box coupled to the second vertical beam such that the second storage box is positioned above the articulated end and such that the second storage box extends from the second vertical beam away from the articulated end, the second storage box configured to store an interbox connector.

12. The railcar of claim 10, further comprising:

a coupler end configured to couple the railcar to a locomotive;

a second storage assembly coupled to the coupler end, the second storage assembly comprising:

a second vertical beam coupled directly to the coupler end, the second vertical beam extending vertically upwards from the coupler end, the second vertical beam extending vertically higher than the coupler end;

a third vertical beam coupled directly to the coupler end, the third vertical beam extending vertically upwards from the coupler end, the third vertical beam extending vertically higher than the coupler end; and a second storage box coupled to the second and third vertical beams such that the second storage box is positioned above the coupler end and such that the second storage box is positioned between the second and third vertical beams, the second storage box configured to store an interbox connector.

13. The railcar of claim 10, wherein the first storage box comprises a first section and a second section, the first section separated from the second section, the first section configured to store a first interbox connector, the second section configured to store a second interbox connector.

14. The railcar of claim 10, wherein the first storage assembly further comprises a reinforcement arm coupled to the first vertical beam and the first storage box.

15. The railcar of claim 10, wherein the first storage assembly further comprises a handrail coupled to the first storage box.

16. The railcar of claim 10, wherein a vertical position of the first storage box on the first vertical beam is adjustable.

17. The railcar of claim 10, further comprising a well configured to hold an International Organization for Standardization container.

18. The railcar of claim 10, wherein the first storage box comprises a first section, a second section, a third section, and a fourth section, the first section separated from the second, third, and fourth sections, the second section separated from the first, third, and fourth sections, the third section separated from the first, second, and fourth sections, the fourth section separated from the first, second, and third sections, the first section configured to store a first interbox connector, the second section configured to store a second interbox connector, the third section configured to store a third interbox connector, the fourth section configured to store a fourth interbox connector.

19. A railcar comprising:

an articulated end configured to couple the railcar to another railcar; and a first storage assembly coupled to the articulated end, the first storage assembly comprising:

a first vertical beam coupled directly to the articulated end, the first vertical beam extending vertically upwards from the articulated end, the first vertical beam extending vertically higher than the articulated end; and a first storage box coupled to the first vertical beam such that the first storage box is positioned above the articulated end and such that the first storage box extends from the first vertical beam away from the articulated end, the first storage box configured to store an interbox connector;

wherein the first storage box comprises a first section, a second section, a third section, and a fourth section, the first section separated from the second, third, and fourth sections, the second section separated from the first, third, and fourth sections, the third section separated from the first, second, and fourth sections, the fourth section separated from the first, second, and third sections, the first section configured to store a first interbox connector, the second section configured to store a second interbox connector, the third section configured to store a third interbox connector, the fourth section configured to store a fourth interbox connector.

20. The railcar of claim 19, further comprising a second storage assembly coupled to the articulated end, the second storage assembly comprising:

a second vertical beam coupled directly to the articulated end, the second vertical beam extending vertically upwards from the articulated end, the second vertical beam extending vertically higher than the articulated end; and a second storage box coupled to the second vertical beam such that the second storage box is positioned above the articulated end and such that the second storage box extends from the second vertical beam away from the articulated end, the second storage box configured to store an interbox connector.

* * * * *